United States Patent [19]

Brazil

[11] Patent Number: 4,708,283

[45] Date of Patent: Nov. 24, 1987

[54] REINFORCING RING CONSTRUCTION FOR CONTAINERS

[75] Inventor: Michael J. Brazil, Parkville, Mo.

[73] Assignee: Sealright Co., Inc., Kansas City, Mo.

[21] Appl. No.: 826,382

[22] Filed: Feb. 5, 1986

[51] Int. Cl.[4] ..... B65D 3/30

[52] U.S. Cl. ..... 229/5.5; 220/73; 229/5.6; 229/5.7

[58] Field of Search ..... 229/4.5, 5.5, 5.6, 5.7, 229/5.8; 220/67, 73

[56] References Cited

U.S. PATENT DOCUMENTS

| | | | |
|---|---|---|---|
| 1,256,933 | 2/1918 | Schriner | 220/73 |
| 1,700,164 | 1/1929 | Hulbert | 229/5.7 |
| 1,702,606 | 2/1929 | Hulbert | 229/5.7 |
| 2,170,436 | 8/1939 | Vogel | 229/5.6 |
| 2,185,171 | 1/1940 | Brown | 229/5.7 |
| 3,596,827 | 8/1971 | Kinney | 229/5.6 |

FOREIGN PATENT DOCUMENTS

| | | | |
|---|---|---|---|
| 847575 | 8/1952 | Fed. Rep. of Germany | 229/5.7 |
| 4745 | 9/1905 | France | 229/5.6 |
| 255588 | 2/1949 | Switzerland | 229/5.5 |
| 368743 | 5/1963 | Switzerland | 229/5.5 |

*Primary Examiner*—Stephen Marcus
*Assistant Examiner*—Gary E. Elkins
*Attorney, Agent, or Firm*—Kokjer, Kircher, Bradley, Wharton, Bowman & Johnson

[57] ABSTRACT

In a metal reinforcing ring applied to the top edge of a paperboard container, an improved construction which avoids presenting any sharp edges by curling the lower edge of the reinforcing ring under a shoulder on the inside of the container such that the lower edge of the ring is butted against the inside container surface at an unexposed location. Special crimping rolls apply the reinforcing ring to the top edge of the container.

10 Claims, 3 Drawing Figures

REINFORCING RING CONSTRUCTION FOR CONTAINERS

BACKGROUND AND SUMMARY OF THE INVENTION

This invention relates generally to paperboard containers and more particularly to an improved construction for a metal ring used to reinforce and protect the upper edge of a large paperboard container.

Cylindrical paperboard containers are used in a variety of packaging applications, including the packaging of foods. Relatively large diameter paperboard containers having a capacity of 3 gallons more or less are widely used to package food products in bulk quantities. The edges of these large containers are susceptible to being frayed and torn and are generally lacking in structural strength. Typically, a metal reinforcing ring is applied to the upper edge of the container to provide it with the necessary strength and protection.

The metal reinforcing rings that have been used in the past are applied to the container by crimping rolls which roll a rim portion of the ring over the top edge of the container. The ring is held in place on the container by an edge of the rolled rim which bites into the container wall. The ring extends along the inside surface of the container and terminates in a lower edge which lies against the inside surface of the container wall. Although this type of reinforcing ring functions well to strengthen and protect the edge of the container, it has not been entirely satisfactory in all respects. Perhaps most notably, the lower edge of the ring is an exposed edge which can cut the fingers and hands of persons reaching into the container. In addition, the manner in which the ring is fastened on the rim of the container is lacking somewhat in security, and this detracts from the structural integrity of the rim area of the container.

The present invention is directed to an improved reinforcing ring which is applied to the container in a manner to eliminate all exposed edges and other sharp or hazardous surfaces. The reinforcing ring is also held in place more securely than the rings that have been used in the past.

In accordance with the invention, a pair of crimping rolls act to crimp the reinforcing ring onto the upper edge of a paperboard container. The crimping rolls have specially formed shaping surfaces which roll the rim of the reinforcing ring over the container edge and press a band portion of the ring against the inside surface of a reduced diameter neck which is formed on the container by the crimping rolls. It is a particular feature of the invention that the shaping surfaces of the crimping rolls are arranged to curl a lip on the lower edge of the ring under and along a shoulder which extends between the neck and the main body of the container. The free edge of the curled lip is butted against the inside of the container wall where it is not exposed and is not susceptible to catching on or cutting the fingers or hands. A series of sharply pointed pins are carried on the inside crimping roll to form teeth on the band portion of the ring which bite into the container in opposition to the edge of the rolled rim in order to strengthen the connection between the reinforcing ring and the container.

DETAILED DESCRIPTION OF THE INVENTION

In the accompanying drawing which forms a part of the specification and is to be read in conjunction therewith and in which like reference numerals are used to indicate like parts in the various views.

Figure 1:
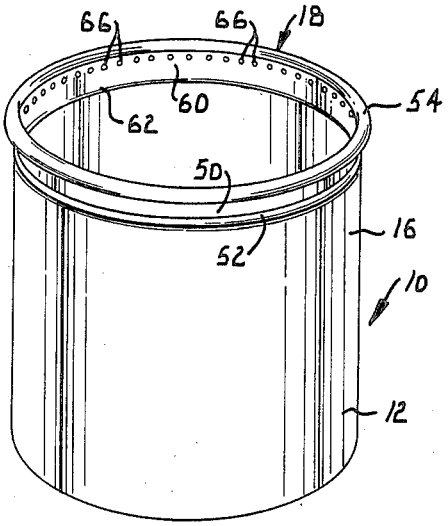
FIG. 1 is a perspective view of a paperboard container equipped with a metal reinforcing ring applied to the upper edge of the container in accordance with the present invention.
Figure 2:
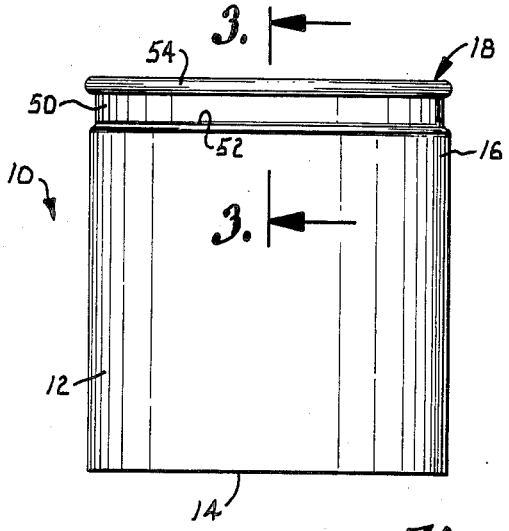
FIG. 2 is an elevational view of the container shown in FIG. 1.

Referring now to the drawing in more detail, numeral 10 generally designates a paperboard container of the type which may be used to package food items in bulk quantity. The container 10 has a cylindrical or tubular body 12 which is open at the top and which includes a closed bottom 14 that may be formed in any suitable manner. The body 12 has a cylindrical wall 16 formed from paperboard or a similar material. A removable lid (not shown) covers the top of container 10 when fitted thereon.

Numeral 18 generally designates a metal reinforcing ring which is applied to the upper edge portion of the container body 12 for the purpose of strengthening and protecting the upper edge of the container. The ring 18 is formed by a strip of a suitable metal such as steel or aluminum having adequate strength to reinforce the upper edge of the paperboard container.

Figure 3:
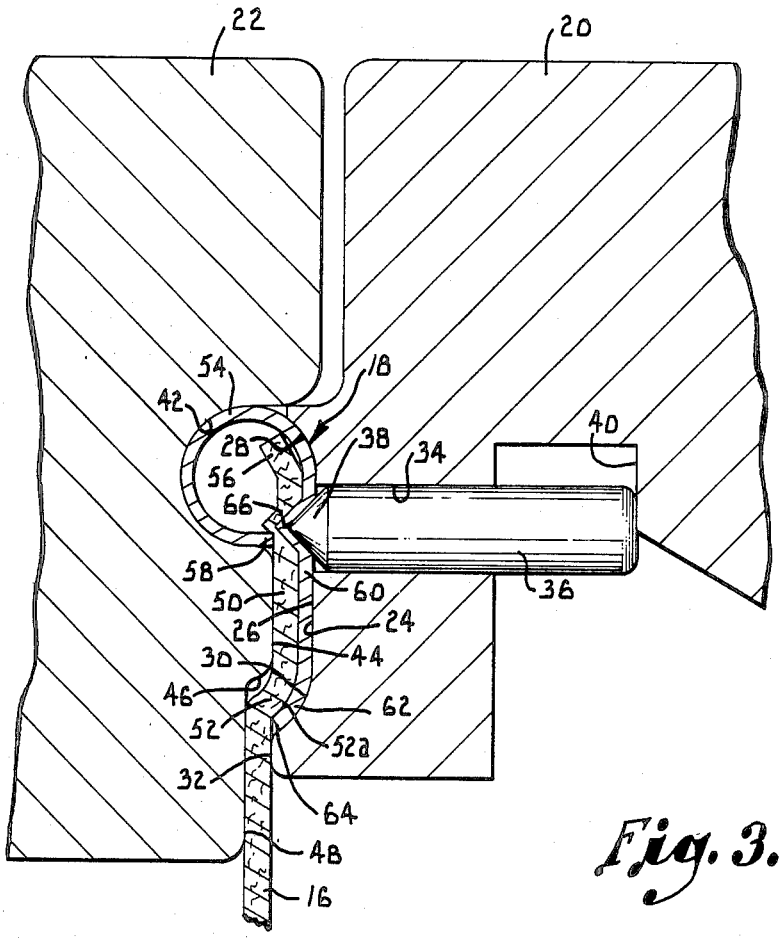
FIG. 3 is a fragmentary sectional view on an enlarged scale taken generally along line 3—3 of FIG. 2 in the direction of the arrows and showing portions of the special crimping rolls which are used to apply the reinforcing ring to the container edge.

Referring now to FIG. 3, the reinforcing ring 18 is applied to the container by a pair of crimping rolls 20 and 22 having specially formed shaping surfaces that act to crimp the reinforcing ring onto the container edge. Crimping roll 20 is located inside of the container and includes on its shaping surface a recess 24 which has a flat base surface 26. A curved upper surface 28 is formed on recess 24 above the base surface 26, and a similarly curved lower surface 30 is formed on the recess below the base surface 26. A flat (in section) surface 32 is formed below the curved surface 30 and extends parallel to the base surface 26. Surface 32 projects beyond the base surface 26.

The inside crimping roll 20 is provided with a plurality of radial passages 34 which extend into recess 24 and intersect with the flat base surface 26. Each passage 34 is provided with a punch pin 36 having a sharply pointed tip 38 which projects into recess 24 beyond the base surface 26. The butt end of each pin 36 is engaged against a shoulder 40 formed on the crimping roll 20.

The other crimping roll 22 is located outside of the container and has a specially formed shaping surface which confronts the shaping surface of the inside crimping roll 20. The shaping surface of crimping roll 22 includes a generally semi-circular recess 42 which is located outwardly of and in opposition to upper curved surface 28 and the upper portion of the flat base surface 26. The lower end of recess 42 is generally aligned with the center of each of the passages 34. A flat (in section) surface 44 extends below the recess 42. A curved shoulder surface 46 intersects with surface 44 and faces generally downwardly and inwardly toward the lower curved surface 30. Surface 44 generally opposes the base surface 26 of recess 24. Another surface 48 which is flat in section extends below the shoulder 46 and is arranged generally in opposition to surface 32 on the opposing shaping surface.

The crimping rolls 20 and 22 are applied to the upper edge portion of container 12 and to the reinforcing ring 18 in the manner shown in FIG. 3. The opposing surfaces 32 and 48 engage the respective inside and outside surfaces of the container wall 16. Surface 44 engages the outside surface of the upper edge portion of the container and displaces it inwardly somewhat to form a reduced diameter neck 50 on the upper edge portion of the container wall. Recess 24 opposes surface 44 and accommodates the inward deflection of the container wall to form the neck 50. Neck 50 is connected with the main portion of the container wall by a small shoulder 52 which is formed between shoulder surface 46 and the lower curved surface 30. The shoulder 52 presents a curved surface 52*a* which faces generally downwardly and inwardly into the container.

The metal reinforcing ring 18 is crimped onto the neck 50. The crimping action provided by the crimping rolls causes a rim portion 54 of the ring to be rolled along the surface of recess 42 over the top edge 56 of neck 50. Edge 56 is itself deflected outwardly somewhat within the rolled rim 54, as shown in FIG. 3. The rolled rim 54 terminates in an edge 58 which butts against and bites or digs into the outer surface of the neck 50 somewhat below the top edge 56. The opposing surfaces 44 and 26 press a generally flat band portion 60 of ring 18 against the inside surface of neck 50. In addition, the lower curved surface 30 curls a lip portion 62 on the lower end of ring 18 under and along surface 52*a* of shoulder 52. The curled lip 62 is thus flared outwardly somewhat as it extends downwardly along surface 52*a*. The lower end 64 of lip 62 is butted against the inside surface of the container wall 16 at its intersection with the shoulder 52. Consequently, edge 64 is at an unexposed location where it will not cut or catch on fingers or hands which reach down inside the container. The fingers and hands are able to easily slide along the smoothly curved surface of lip 62.

The tips 38 of pins 36 are punched into the band 60 of the reinforcing ring to form sharply pointed teeth 66 which bite into of neck 50 from the inside. The teeth 66 are spaced uniformly around band 60 and are located generally in alignment with and in opposition to the edge 58 which bites into the outside surface of the neck. This enhances the security with which the reinforcing ring 18 is fastened to the container. In addition, the curling of lip 62 beneath shoulder 52 acts to oppose any tendency for the reinforcing ring to slip off of the upper edge portion of the container 10. The inset configuration of neck 50 itself strengthens the upper edge portion of the container wall and enhances the reinforcement provided by ring 18.

By way of example, it has been found that satisfactory results are obtained with a crimping roll arrangement in which recess 42 has a diameter of approximately 0.16 inch, surface 44 has a height dimension of approximately 0.118 inch, and the upper and lower curved surfaces 28 and 30 curve along radii of approximately 0.087 inch and 0.070 inch, respectively. It is to be understood, however, that arrangements having other dimensions can be used without departing from the present invention.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A container for bulk materials comprising:

a stepped container body closed at the bottom and having a generally cylindrical container wall presenting inside and outside surfaces and a reduced diameter neck on said wall terminating in a generally circular top edge;

a shoulder interconnecting said container wall and neck and presenting inside of the container body a curved shoulder surface which curves between the inside surface of the neck and the inside surface of the container wall;

a metal reinforcing ring crimped on said top edge of the neck;

a rolled rim portion of said ring, said rim portion curving over said top edge of the neck and terminating in an edge biting into said outside surface of the wall below said top edge; and a band portion of said ring integral with said rim portion and extending generally downwardly therefrom along said inside surface of the neck, said band portion having a curled outwardly flared lip terminating in a lower edge located adjacent said inside surface of the wall to dispose said lower edge at an unexposed location recessed outwardly of said neck wherein fingers are not subject to catching on it.

2. The container of claim 1, including a plurality of teeth on said band portion of the ring biting into said inside surface of the container wall.

3. The container of claim 2, wherein said teeth are generally in alignment with said edge of the rim portion of said ring and act in opposition to said edge.

4. In a container body having a generally cylinderical container wall with inside and outside surfaces, an upper edge construction comprising:

a generally cylindrical neck having inside and outside surfaces and a diameter less than the diameter of the container wall, said neck terminating in a top edge of the container body;

a shoulder portion of the container body extending between and interconnecting the container wall and neck, said shoulder portion presenting a shoulder surface facing into the container body;

a metal reinforcing ring crimped on said neck;

a rim portion of said ring curving over said top edge of the container body and having an edge engaging said outside surface of the neck at a location below said top edge of the container body; and a band portion of said ring integral with said rim portion and extending therefrom along said inside surface of the neck, said band portion having an out-turned lip extending along said shoulder surface and terminating in a lower edge located outwardly of the inside surface of the neck at a recessed location.

5. The construction of claim 4, including a plurality of teeth on said band portion of the ring, said teeth biting into said inside surface of the neck.

6. The construction of claim 5, wherein said teeth are located substantially in opposition to said edge of the rim portion of the ring.

7. The construction of claim 4, wherein:

said shoulder surface comprises a curved surface; and said lip is curled outwardly under and along said curved surface.

8. The construction of claim 7, wherein said lower edge of said lip is located adjacent the inside surface of the container wall.

9. A container comprising:

a stepped container body having a generally cylindrical wall presenting inside and outside surfaces;

a generally cylindrical neck on said container body having a lesser diameter than said wall and joined to the wall by the shoulder which presents a shoulder surface facing into the container body, said neck having inside and outside surfaces and terminating in a generally circular top edge;

a metal reinforcing ring crimped on said top edge and having a rim portion which curves over said top edge terminates in an edge which engages the outside surface of said neck below said top edge; and a band portion of said reinforcing ring extending along said inside surface of the neck and having an out-turned lip extending along and under said shoulder surface, said lip terminating in a lower edge recessed outwardly of said inside surface of the neck at an unexposed location.

10. The container of claim 9, wherein:

said shoulder surface comprises a curved surface; and said lip is curled along said curved surface in an outwardly flared configuration.

* * * * *